US007469849B1

(12) United States Patent
Lo

(10) Patent No.: US 7,469,849 B1
(45) Date of Patent: Dec. 30, 2008

(54) SHREDDER BIN

(76) Inventor: Emily Lo, No. 18, 20 Lane, Hsin Feng Street, Hsin Chuang, Taipei Shien (TW)

( * ) Notice: Subject to any disclaimer, the term of this patent is extended or adjusted under 35 U.S.C. 154(b) by 234 days.

(21) Appl. No.: 11/123,941

(22) Filed: May 4, 2005

(51) Int. Cl.
*B02C 18/22* (2006.01)

(52) U.S. Cl. ..... 241/100; 241/236; 241/285.2

(58) Field of Classification Search ..... 241/100, 241/236, 285.2
See application file for complete search history.

(56) References Cited

U.S. PATENT DOCUMENTS 3,022,129 A * 2/1962 Manson ..... 312/334.38
3,281,198 A * 10/1966 Bates et al. ..... 312/334.41
4,318,575 A * 3/1982 Redlich ..... 312/249.9
4,861,122 A * 8/1989 Newhouse et al. ..... 312/330.1
5,897,065 A * 4/1999 Schwelling ..... 241/100
6,079,645 A * 6/2000 Henreckson et al. ..... 241/37.5
6,962,301 B1 * 11/2005 Chang ..... 241/100
2004/0188553 A1 * 9/2004 Lo ..... 241/36

* cited by examiner

*Primary Examiner*—Mark Rosenbaum
(74) *Attorney, Agent, or Firm*—Pro-Techtor Int'l Services

(57) ABSTRACT

A new and novel split shredder bin includes a frame and an inner bin, wherein only the inner bin needs to be pulled out to remove shredded paper therein instead of removing the shedder as in the prior art.

1 Claim, 4 Drawing Sheets

SHREDDER BIN

BACKGROUND OF THE INVENTION (a) Field of the Invention

The invention relates to a shredder bin, and more particularly to a split shredder bin comprising a frame and an inner bin, wherein tracks at the bottom slide into fillisters located at the bottom of the frame.

(b) Description of the Prior Art

Bins underneath shredders of prior art typically contain shredded paper as trash bins. To pour out the shredded paper, it is rather inconvenient that the shredders mounted atop the bins must first be removed. Furthermore, the shredders can then easily crash or be damaged from frequent hauling. To address this problem, a structure with a separate frame for supporting the paper shredder, and a removable inner bin for collecting the shredded paper has been disclosed.

However, although several designs for such bins have been disclosed in the prior art, none have satisfactorily met all of the desired convenience criteria simultaneously. For example, one approach to prevent jamming on reinsertion has disclosed grooves in the bottom surface of the inner bin which ride on matching ridges on the floor of the frame. This type of bin however is subject to binding, and to being dislodged by vibration of the paper shredder. Another design has guide pins at the trailing edge of the bin bottom to prevent movement from vibration; however, this involves an inconvenient closing motion and a wider gap at the top of the bin allowing the escape of dust and debris.

For maximum convenience, an improved inner bin should be easily removable, be free from jamming during reinsertion, be stable under vibration from the paper shredder, and have tight clearances with the frame opening to prevent paper dust and debris from escaping. However, the prior art has not provided all of these advantages simultaneously.

SUMMARY OF THE INVENTION

The primary object of the invention is to provide a divided shredder bin comprising a frame and an inner bin which can be used with great convenience, instead of a bin placed underneath as in a prior art. Tracks at the bottom of the inner bin, with wheels near the leading edge, slide into fillisters at the bottom of the frame to enable the inner bin to slide in and out of the frame conveniently. Needless to remove the shredder, pouring out the shredded paper may be done by removing the inner bin conveniently, without sacrificing stability or containment.

To better understand objects, characteristics and functions of the invention, detailed descriptions of a preferred embodiment shall be given with the accompanying drawings below.

DETAILED DESCRIPTION OF THE PREFERRED EMBODIMENTS

Figure 1:
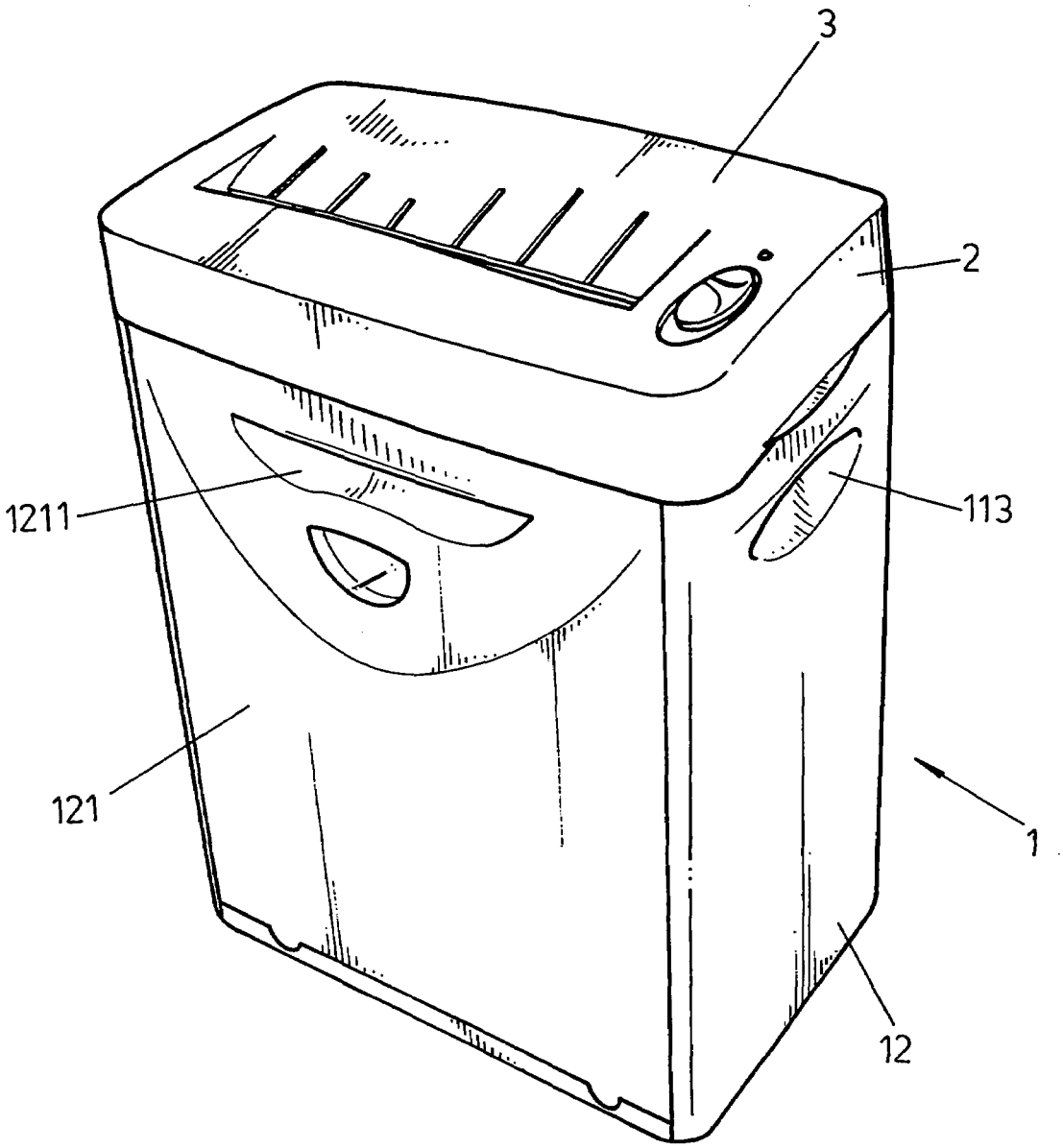
FIG. 1 shows an elevational view according to the invention.
Figure 2:
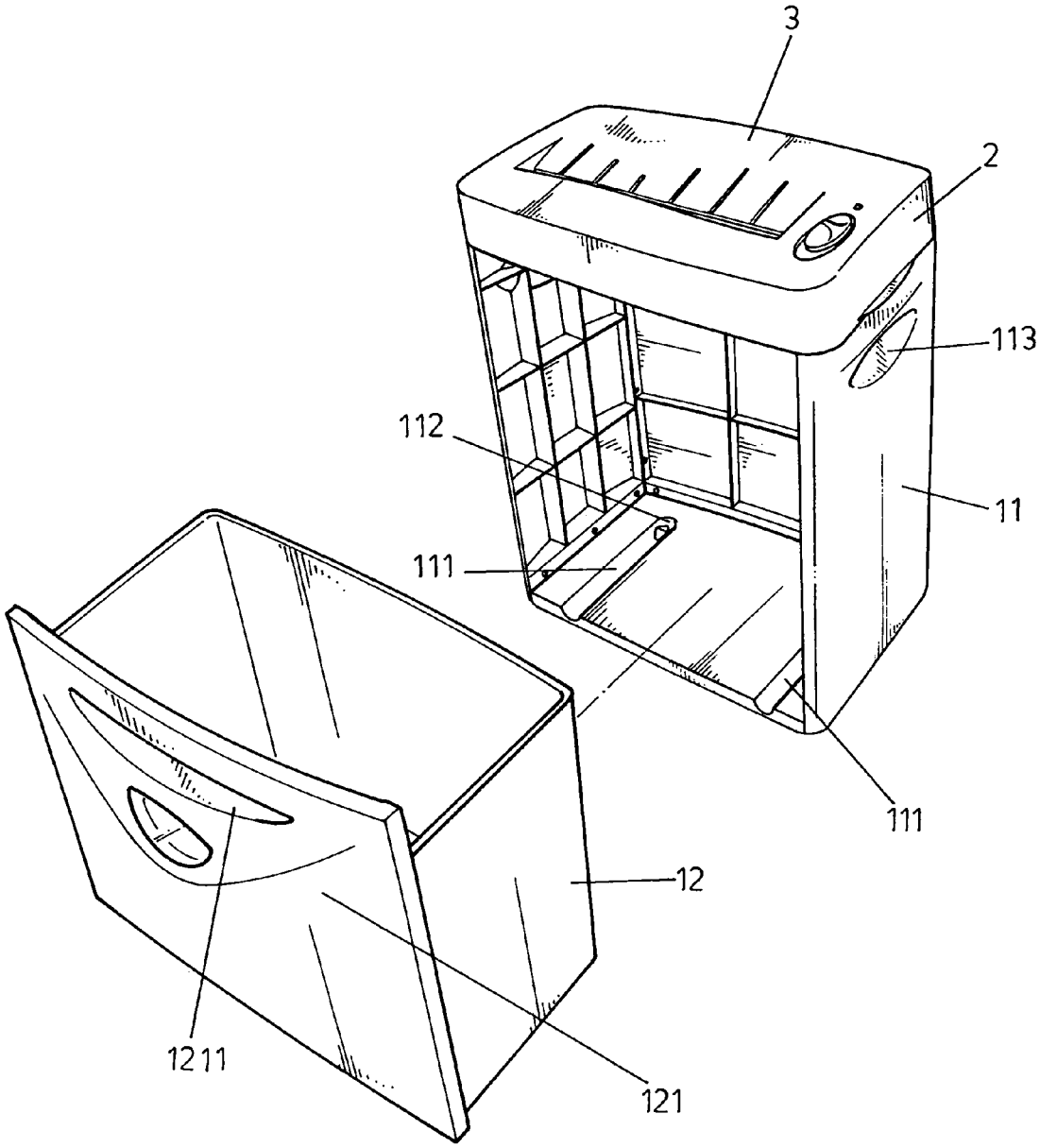
FIG. 2 shows exploded elevational view according to the invention.

As shown in FIG. 1 and FIG. 2, a shredder bin 1 having a base 2 and an upper lid 3 according to the invention comprise characteristics below.

Figure 3:
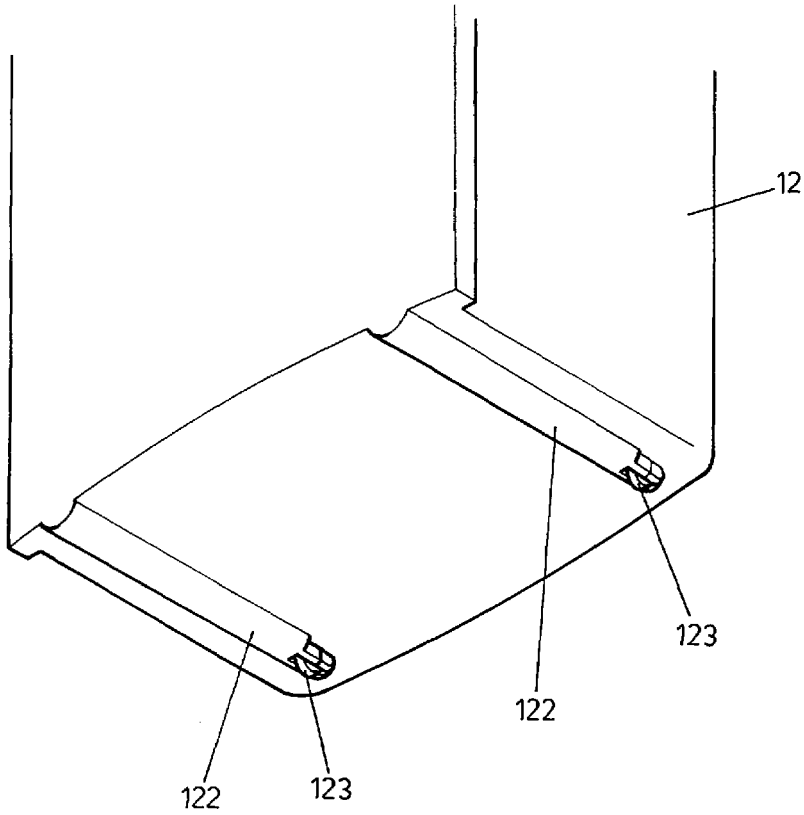
FIG. 3 shows exploded elevational view according to the invention.
Figure 4:
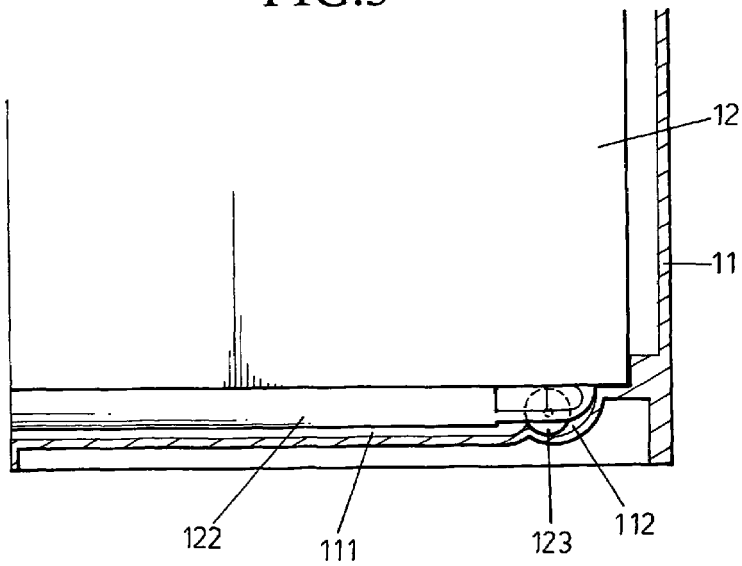
FIG. 4 shows a partial sectional view according to the invention.

The shredder bin 1 is consisted of a frame 11 and an inner bin 12. The top and front sides of the frame 11 are in an opened structure with two straight fillisters 111 formed at a bottom side thereof, and two fixed positioning receptacles 112 located at the ends of the two straight fillisters 111 nearest the back wall of the frame. The inner bin 12 is a top opening tub-like object comprising a frontal board 121, two straight tracks 122 (as shown in FIG. 3) formed at the bottom and a wheel 123 disposed inside each of the tracks near the leading edge of the bin bottom. The tracks of the inner bin 12 slide into the fillisters 111 of frame 11 by wheels 123 which can be held in receptacles 112 near the leading edge of the fillisters 111 (as shown in FIG. 4). When the inner bin 12 has been completely slid into the frame 11, the frontal board 121 of the inner bin 12 and the frame 11 become a shredder bin having a minimal clearance at the top of the inner bin.

A grip 1211 is provided in the frontal board 121 of the inner bin 12. The inner bin 12 can be pulled out conveniently by pulling the grip 1211 with a hand. The shredder bin 1 can be lifted by hands with curving side grips 113 provided at each side of the frame 11.

Figure 5:
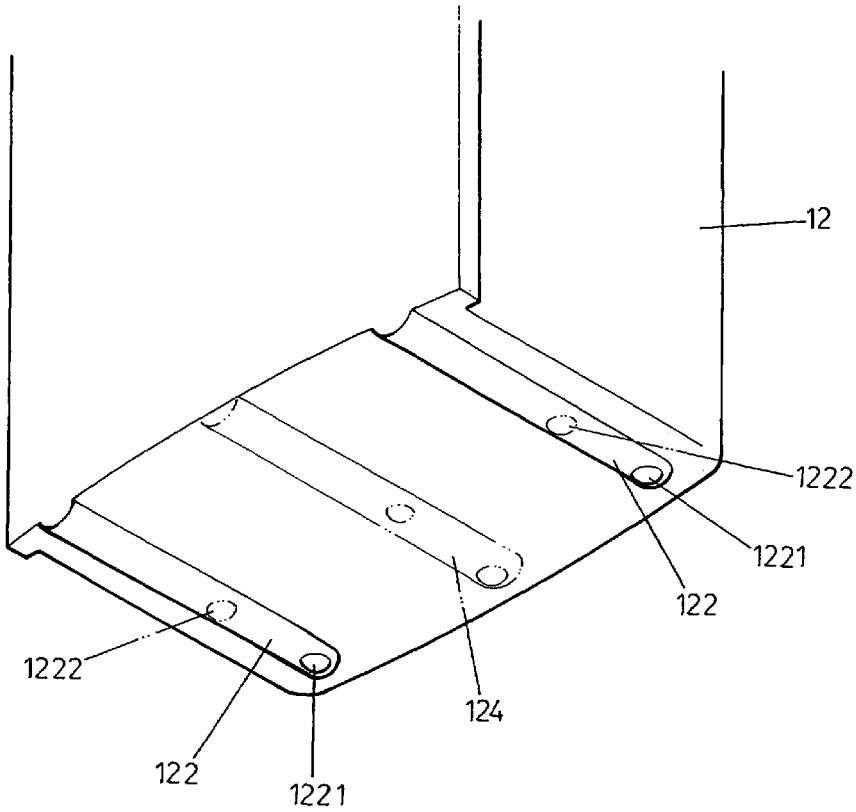
FIG. 5 shows a bottom view of an inner bin in an embodiment according to the invention.
Figure 6:
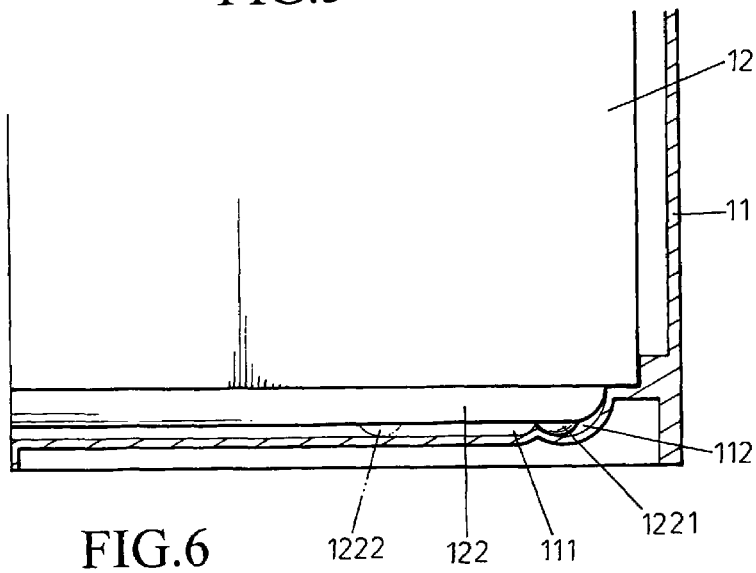
FIG. 6 shows a partial sectional view of an inner bin in an embodiment according to the invention.

As shown in FIG. 5 and FIG. 6, in a second embodiment, three straight tracks 124 and three fillisters 111 are built-in at the inner bin 12 and the frame 11 respectively. Wheels are replaced by semicircular projecting sections 1221 of inner tracks 122 near the leading edge of the inner bin 12 to inset in the receptacles 112 of the frame 11. Another set of projecting sections 1222 may be added before the projecting sections 1221 to ease the sliding action of the inner bin 12.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A shredder bin comprising:

a frame having a top opening a frontal opening, and a closed base, with at least one positioning fillister located inside the frame on an upper surface of said base thereof, said fillister being oriented in a generally normal direction relative to said frontal opening and having a receptacle formed at an end of the fillister near a back wall of said frame, and said top opening of said frame being configured to support a paper shredder; and an easily removeable top-opening inner bin having a frontal board with a grip, at least one guiding track formed at a bottom thereof being positioned to conform to the fillister on the base of the frame, said at least one guiding track having a wheel mounted to said bottom of said inner bin near a leading edge thereof;

wherein the inner bin is adapted to slide into the fillister of the frame, with the wheel engaging the receptacle of the fillister to hold the inner bin in position against vibration, thereby facilitating removal of the shredded paper therein.

* * * * *